US005121693A

United States Patent [19]

Kosteck

[11] Patent Number: 5,121,693

[45] **Date of Patent: * Jun. 16, 1992**

[54] HERMETICALLY SEALED SHOT SHELL HAVING AN INCREASED VOLUME AND A METHOD FOR MAKING SAME

[75] Inventor: Gregory R. Kosteck, Godfrey, Ill.

[73] Assignee: Olin Corporation, Cheshire, Conn.

[ * ] Notice: The portion of the term of this patent subsequent to Feb. 12, 2008 has been disclaimed.

[21] Appl. No.: 590,400

[22] Filed: Sep. 28, 1990

[51] Int. Cl.[5] ..... F42B 7/12

[52] U.S. Cl. ..... 102/462; 102/463; 102/466

[58] Field of Search ..... 102/452, 462, 463, 448, 102/456, 466, 467

[56] References Cited

U.S. PATENT DOCUMENTS

| | | | |
|---|---|---|---|
| 1,624,649 | 4/1927 | Des Allimes | 102/462 |
| 2,232,634 | 2/1941 | Roberts et al. | 102/463 |
| 3,055,302 | 9/1962 | Bayard et al. . | |
| 3,256,815 | 6/1966 | Davidson et al. | 102/452 |
| 3,442,214 | 5/1969 | Huskins . | |
| 3,596,600 | 8/1971 | Himmelsbach, Jr. | 102/462 |
| 4,867,066 | 9/1989 | Buenemann, Jr. . | |
| 4,991,512 | 2/1991 | Van Wyk | 102/462 |

*Primary Examiner*—Deborah L. Kyle
*Attorney, Agent, or Firm*—John R. Wahl

[57] ABSTRACT

An increased volume shotshell having a biaxially oriented plastic tubular body has an end closure disk heat sealed to the open end of the shotshell eliminating the conventional star crimp closure. The increases volume results from making available the space normally taken up by the internal folds of the crimp. The end closure on the open end of the shotshell tube is fused to the tubular body to seal the shot load without destroying the biaxial orientation of the open end of the tubular body.

The method of loading comprises the steps of loading a charge of propellant powder through the open end into the tubular body, inserting a wad, filling the remaining volume of the tubular body full with a load of shot so that the load of shot is substantially level with the open end, placing a disk of thermoplastic material having an annular rim portion onto the end and against the shot so that the rim portion is in immediate surface contact with the end, and heat sealing the rim portion of the disk to the tubular body at the end.

1 Claim, 1 Drawing Sheet

HERMETICALLY SEALED SHOT SHELL HAVING AN INCREASED VOLUME AND A METHOD FOR MAKING SAME

BACKGROUND OF THE INVENTION

This invention relates generally to shotshells and more particularly to a shotshell having a seal forming the end closure over the load of shot.

In the past, many methods of closing the end of a shotshell have been advanced. A folded over end of the shell forming a crimped end has been the most widely accepted form of end closure.

U.S. Pat. No. 3,055,302 discloses a plastic shotshell case having a star shaped crimp end closure. In addition, a polyethylene plug is friction sealed into the central hole in the star crimp by spin welding. This arrangement provides a rather strong, thick and solid end closure but may adversely affect the reloadability of such a casing.

Another example, U.S. Pat. No. 3,442,214 utilizes a rather thick, over shot card 9 of granulated cork impregnated with paraffin wax and a roll crimp end closure. The impregnated cork over shot card may provide a moisture seal over the shot; however, it introduces a substantial parasitic weight to the load.

One major difficulty with all of the prior art end closures is that the interior volume of the case is limited by the length of the tube remaining after the end is folded over or roll crimped onto the paper disk. With the advent of steel shot for waterfowl loads requiring an increased volume, it is desirable to maximize the interior case volume. Various ways of increasing the interior case volume include minimizing the basewad volume as in U.S. Pat. No. 4,867,066, assigned to the assignee of the present invention. Still additional ways of increasing the interior volume would be advantageous while creating a hermetic end seal.

It is therefore an object of the invention to provide a sealed end closure for an uncrimped and unfolded shotshell.

It is another object of the present invention to provide a simple, light weight moisture sealed shotshell having an increased volume that introduces minimal parasitic load.

It is a further object of the present invention to provide a moisture sealing end closure for a shotshell which may be ejected from the shotshell case through the barrel.

It is a still further object of the present invention to provide an end closure for a shotshell that has no adverse impact on the shot pattern.

SUMMARY OF THE INVENTION

The shotshell having an increased volume in accordance with the present invention, in its simplified form, is a shotshell case having a standard overall length with a thin disk shaped member of a thermoplastic material extending radially across the mouth of the case instead of a star shaped folded crimp as in conventional shotshells. An annular rim portion of the disk member is fused to the inside of the mouth of the tubular body of the shotshell while maintaining the overall biaxial orientation of the shotshell body abutting the rim portion. This design increases the interior volume available for shot by eliminating the volume formerly required by the inward folds of the crimp.

The shotshell in accordance with the present invention is produced by loading into an upright primed case having an open mouth end a charge of propellant powder, inserting a wad and shot cup on top of the powder charge, filling the remaining volume of the case full with a load of shot so that the load of shot is substantially level with said mouth end, placing a disk of thermoplastic material having a circular rim portion onto said end so that said rim portion is in immediate contact with said end, and heat sealing the rim portion of the disk to the surface of the shotshell tube at the end to hermetically seal and close the open end of the shotshell.

The seal disk may be any olefinic polymer or copolymer and is preferably a high density polyethylene. A controlled amount of heat is applied ultrasonically or directly to the periphery of the rim portion or to the adjacent tubing which thus melts a surface layer of the polyethylene of the inside of the abutting tube and the rim of the disk to bond the disk to the tubular body of the shell casing.

The application of heat is closely controlled so as to just fuse the rim portion of the disk and a very thin surface portion of the inner wall surface of the tubular casing together at or adjacent the end so that the biaxial orientation of the tubular casing is not destroyed, yet sufficient to provide an annular bond and a hermetic seal. The heat may be applied with any appropriately shaped heating tool such as one having a conical cup or trumpet shaped head to fit over the circular end of the shotshell. When the heating tool is removed and the end seal is allowed to cool, a permanent fused seal is secured across the crimped end of the shotshell.

The sealing disk also may be formed of a composite as disclosed in U.S. patent application Ser. No. 07/431,509 which is herein incorporated by reference.

The end seal in the shotshell of the invention is preferably installed in the end of the tubular case and bonded to the inner wall of the tube at the open end. Alternatively the end seal may be installed across the end with the rim portion bonding with the end surface of the tube. In either case, the disk shaped end seal forms a continuous annular contact and seal with the tubular shotshell casing.

For internal installation, the disk preferably has an outer diameter equal to the inside diameter of the shotshell. The rim portion preferably has a "T" shaped radial cross section so as to present a large bonding surface against the wall of the shotshell tube. The rim portion of the seal is heat bonded to the tubular wall. Heat may be applied directly to the tube or the rim portion of the seal or by friction. In the latter case the disk or the shotshell tube may be rotated as the disk is inserted into the tube creating friction which melts the contacting surface layers to form the bond. An appropriately shaped annular tool may alternatively be rotated to provide the necessary frictional heat to form the bond.

A critical feature is that the heat applied is controlled in such a manner as to prevent the overall destruction of biaxial orientation of the polyethylene in the tubular case wall. Only a small surface layer portion of the tubular wall is fused together with the thermoplastic disk seal. Thus only the biaxial orientation of this surface layer is disturbed. The overall biaxial orientation of the tubular wall remains intact. In this way, the effective strength of the tubular case at the end is maintained.

DETAILED DESCRIPTION OF THE PREFERRED EMBODIMENTS

Figure 1:
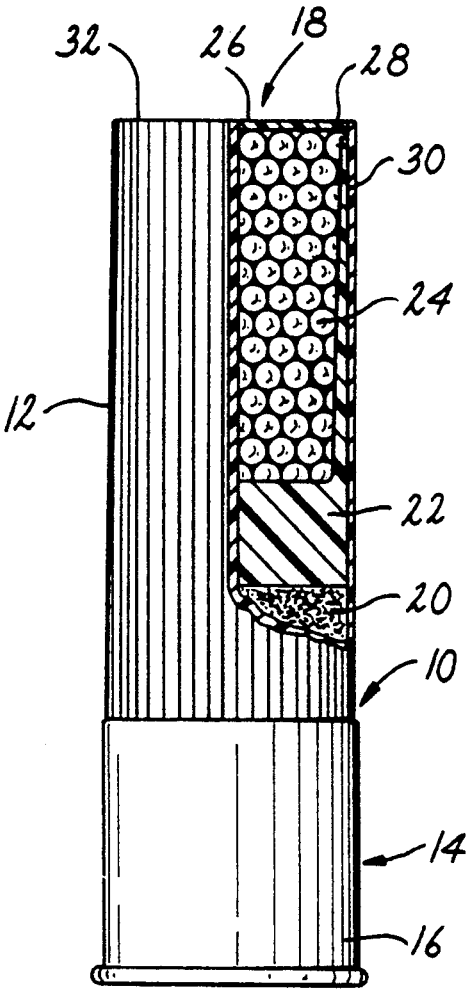
FIG. 1 is an elevational sectional view of a shotshell in accordance with the present invention.

A shotshell 10 having a tubular body 12 having a standard finished length and having a head end 14 closed with a metal rimmed end head 16 and an opposite, open end 18 is shown in FIG. 1. The shotshell 10 is loaded with a propellant 20, a wad and shot cup structure 22, and a load of lead or steel shot 24. The load of shot preferably extends completely to the end 18. The tubular body 12 is made of a biaxially oriented high density polyethylene plastic material. The end closure over open end 18 is a disk 26 having an annular rim portion 28. The closure disk 26 is preferably made of the same material as is the tubular body 12, i.e. high density polyethylene and may also include a copolymer additive such as polyvinyl acetate.

The end closure disk 26 on the tubular body 12 abuts against the top layer of the shot load. The radius of the disk 26 is the same as the inside radius of the tubular body 12 so that the outer radial surface of the rim portion 28 of the disk 26 contacts the inside surface 30 of the tubular body 12.

Figure 2:
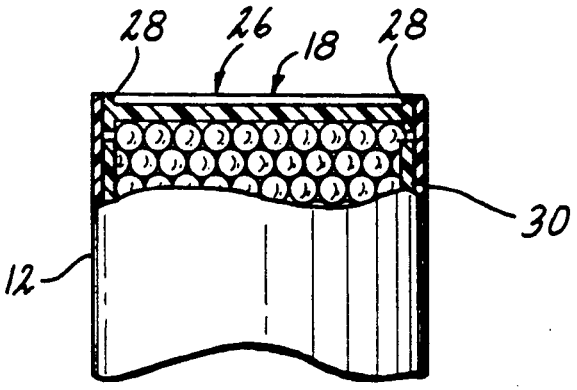
FIG. 2 is a partial sectional enlarged view of the shotshell in FIG. 1.

Rim portion 28 preferably is a tubular flange having a "T" shape in radial cross section as shown in FIG. 2. The head of the "T" shape provides a large surface area in contact with the adjacent tubular wall surface 30 of the shotshell body 12. At least an annular part of the rim portion is fused to the tubular body 12 of the shotshell 10 at end 18 to close the end.

Figure 3:
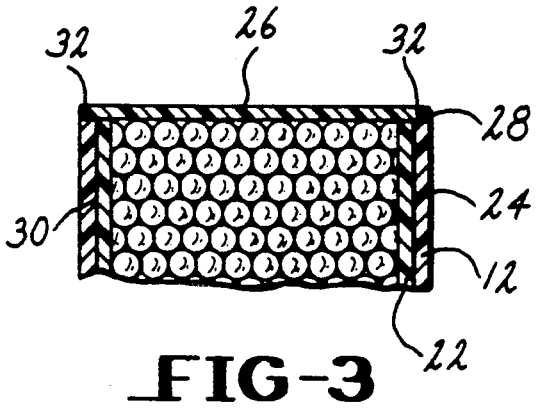
FIG. 3 is an elevational sectional view of the an alternative end closure of a shotshell in accordance with the present invention.

The closure 26 may alternatively have an outer diameter equal to the outer diameter of the tubular body 12 as shown in FIG. 3. In this case the axial end surface 32 of the tubular body 12 rather than the inside surface 30 of the tubular body 12 contacts the rim portion 28 of the end closure 26.

The disk 26 can be spun as it is inserted into or onto the end 18 of the tubular body 12 to create frictional heat to bond the surfaces together or the heat may be applied directly to either the adjacent wall or the rim portion 28 with an appropriately shaped heater. Alternatively an appropriately shaped annular tool may be spun creating the necessary friction between the tool and the contacting surfaces to fuse them together.

In both of the embodiments, a controlled application of heat to the region of the joint causes part of the the rim portion 28 to melt, fusing it to the contacting circular surface 30 at the end 18 of the tubular body 12. A critical feature is that the heat applied is controlled in such a manner as to prevent the overall destruction of biaxial orientation of the polyethylene in the tubular body wall. Only a small surface layer portion of the tubular wall is fused together with rim portion 28 of the closure disk 26. Thus only the biaxial orientation of this surface layer is disturbed. The overall biaxial orientation of the tubular body 12 remains intact. In this way, the effective strength of the tubular case at the end 18 is maintained.

The length of the tubular body 12 is preferably identical to a conventional loaded shotshell which, when loaded, has its end folded over to form a star shaped end closure over the shot. However, in the present invention, the end of the tubular body 12 is not folded over. The internal volume normally taken up by the inward folds of the star crimp or roll crimp material is now available for additional shot, propellant or wadding structures that may be desirable in a particular load. This increased volume permits, for example, a substantial increase in the shot volume available for steel shot in waterfowl loads.

The shotshell 10 in accordance with the present invention is produced by loading into an upright primed case having a tubular body 12 and an open mouth end 18 a charge of propellant powder 20, inserting a wad and shot cup 22 on top of the powder charge 20, filling the remaining volume of the case full with a load of shot 24 so that the load of shot 24 is substantially level with the mouth end 18, placing a disk 26 of thermoplastic material having a circular rim portion 28 onto the end 18 so that the rim portion 28 is in immediate contact with either the radial end surface 32 or the inside surface 30 of the tubular body 12 at the end 18, and heat sealing the rim portion 28 of the disk 26 to the surface of the shotshell tube 12 at the end 18 to hermetically seal and close the open end 18 of the shotshell tube 12, retaining the load of shot 24 in a fixed internal position.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. An increased volume shotshell comprising:

a biaxially oriented tubular plastic body having a head end and an opposite circular uncrimped open end, said body containing a propellant charge, a wad, and a load of shot; and a generally circular thermoplastic end closing member closing said opposite end over and abutting against said load of shot, said member having a preformed T shaped tubular flange rim portion of thermo plastic material fused to an inside surface of said tubular body without destroying the overall biaxial orientation of said body adjacent said rim portion.

* * * * *